US009102151B2

(12) United States Patent
Minami

(10) Patent No.: US 9,102,151 B2
(45) Date of Patent: Aug. 11, 2015

(54) LIQUID EJECTION HEAD AND METHOD FOR PRODUCING THE SAME

(71) Applicant: CANON KABUSHIKI KAISHA, Tokyo (JP)

(72) Inventor: Seiko Minami, Warabi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/503,796

(22) Filed: Oct. 1, 2014

(65) Prior Publication Data

US 2015/0116426 A1 Apr. 30, 2015

(30) Foreign Application Priority Data

Oct. 30, 2013 (JP) ..... 2013-225401

(51) Int. Cl.
*B41J 2/16* (2006.01)
*B41J 2/14* (2006.01)

(52) U.S. Cl.
CPC ..... *B41J 2/1433* (2013.01); *B41J 2/1607* (2013.01); *B41J 2/1628* (2013.01); *B41J 2/1637* (2013.01); *B41J 2/1642* (2013.01)

(58) Field of Classification Search
CPC ..... B41J 2202/19; B41J 2/14; B41J 2/145; B41J 2002/14362; B41J 2002/14459; B41J 2/1623; B41J 2/1642; B41J 2/1408; B41J 2/1626; B41J 2/17513
USPC ..... 347/40–44, 48–49, 61
See application file for complete search history.

(56) References Cited

U.S. PATENT DOCUMENTS 7,600,856 B2 10/2009 Lebens et al.
2014/0292914 A1* 10/2014 Enomoto et al. ..... 347/33

* cited by examiner

*Primary Examiner* — Thinh Nguyen
(74) *Attorney, Agent, or Firm* — Fitzpatrick, Cella, Harper & Scinto

(57) ABSTRACT

A liquid ejection head including a substrate having an ejection-energy-generating element for generating energy for ejecting a liquid; an orifice plate including at least an ejection-orifice-forming wall that constitutes an ejection orifice for ejecting the liquid and an upper wall of a liquid chamber communicating with the ejection orifice, and a liquid chamber side wall that constitutes a side wall of the liquid chamber. The orifice plate is formed of an inorganic material. The liquid ejection head includes a plurality of liquid chambers; and an elastic member filled into a depressed portion formed between the liquid chamber side wall of one liquid chamber of the liquid chambers adjacent to each other and the liquid chamber side wall of the other liquid chamber. The upper end of the elastic member is arranged in a position higher than an upper face of the ejection-orifice-forming wall.

11 Claims, 6 Drawing Sheets

LIQUID EJECTION HEAD AND METHOD FOR PRODUCING THE SAME

BACKGROUND OF THE INVENTION

1. Field of the Invention

The present invention relates to a liquid ejection head which ejects a liquid, and a method for producing the same.

2. Description of the Related Art

U.S. Pat. No. 7,600,856 discloses a liquid ejection head which has an orifice plate formed of an inorganic material. In U.S. Pat. No. 7,600,856, firstly, a mold material is formed in a portion in which a liquid chamber is formed. Subsequently, an orifice plate is formed on the mold material with a chemical vapor deposition method (CVD: Chemical Vapor Deposition).

SUMMARY OF THE INVENTION

The present invention provides a liquid ejection head which includes a substrate having an ejection-energy-generating element for generating energy for ejecting a liquid; an orifice plate including at least an ejection-orifice-forming wall that constitutes an ejection orifice for ejecting the liquid and an upper wall of a liquid chamber communicating with the ejection orifice, and a liquid chamber side wall that constitutes a side wall of the liquid chamber, wherein the orifice plate is formed of an inorganic material, the liquid ejection head includes a plurality of liquid chambers; and an elastic member filled into a depressed portion formed between the liquid chamber side wall of one liquid chamber of the liquid chambers adjacent to each other and the liquid chamber side wall of the other liquid chamber, and an upper end of the elastic member is arranged in a position higher than an upper face of the ejection-orifice-forming wall.

The present invention provides a method for producing the liquid ejection head, which includes: (1) forming a mold material of the liquid chamber on the substrate; (2) forming the orifice plate on the mold material by a chemical vapor deposition method; (3) forming an etching mask so as to cover the orifice plate; and (4) forming the ejection orifice by using the etching mask, wherein the etching mask is left to function as the elastic member.

Further features of the present invention will become apparent from the following description of exemplary embodiments with reference to the attached drawings.

DESCRIPTION OF THE EMBODIMENTS

Figure 1A:
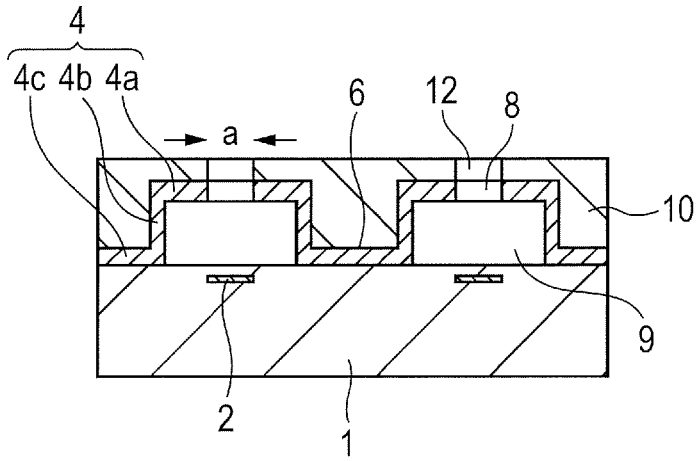
FIGS. 1A, 1B, 1C and 1D are schematic cross-sectional views illustrating examples of a configuration of a liquid ejection head according to an embodiment of the present embodiment.

Preferred embodiments of the present invention will now be described in detail in accordance with the accompanying drawings.

In the method described in U.S. Pat. No. 7,600,856, when the orifice plate is formed with the use of an inorganic material, the orifice plate tends to have low toughness and is occasionally inferior in durability, which comes from the nature of the inorganic material. Because of this, there has been the case where the ejection-orifice-forming wall of the orifice plate is broken by an external force originating in the clogging of paper or the like, and where the liquid ejection head cannot control the liquid ejection.

Thus, an object of the present invention is to provide a liquid ejection head which has an orifice plate formed of an inorganic material and is excellent in durability.

A liquid ejection head provided by the present invention can be mounted on an apparatus such as a printer, a copying machine, a facsimile having a communication system, and a word processor having a printer unit, and further on an industrial recording apparatus which is combined complexly with various processing apparatuses. By using the apparatus having the liquid ejection head mounted thereon, an image can be recorded on various recording media such as paper, yarn, fiber, leather, metal, plastic, glass, wood and ceramics. In the present invention, "recording" means not only an operation of giving an image having meaning such as a character and a figure, but also an operation of giving an image having no meaning such as a pattern, onto a recording medium. Furthermore, "liquid" should be widely interpreted, and shall mean a liquid which is provided onto a recording medium for forming an image, a design, a pattern and the like thereon, for processing the recording medium, or for treating ink or the recording medium. Here, treating the ink or the recording medium includes, for instance, enhancing the fixability of ink to be given onto the recording medium by solidifying or insolubilizing a coloring material in the ink, enhancing a recording grade or color developability, and enhancing the durability of an image.

In addition, in the following description, a main application example of the present invention will be described regarding an ink jet recording head, but the applicable range of the present invention is not limited to the ink jet recording head. In addition, the liquid ejection head can be applied also to a method for producing a liquid ejection head for use in producing a biochip and in printing an electronic circuit, in addition to the ink jet recording head. The liquid ejection head is, for instance, used also in producing a color filter, and the like.

The present invention will be described below while embodiments are described with reference to the drawings. However, the embodiments described below do not limit the scope of the present invention, and are provided so that the present invention is sufficiently described for those who have ordinary skill in this art.

Embodiment 1

Figure 3:
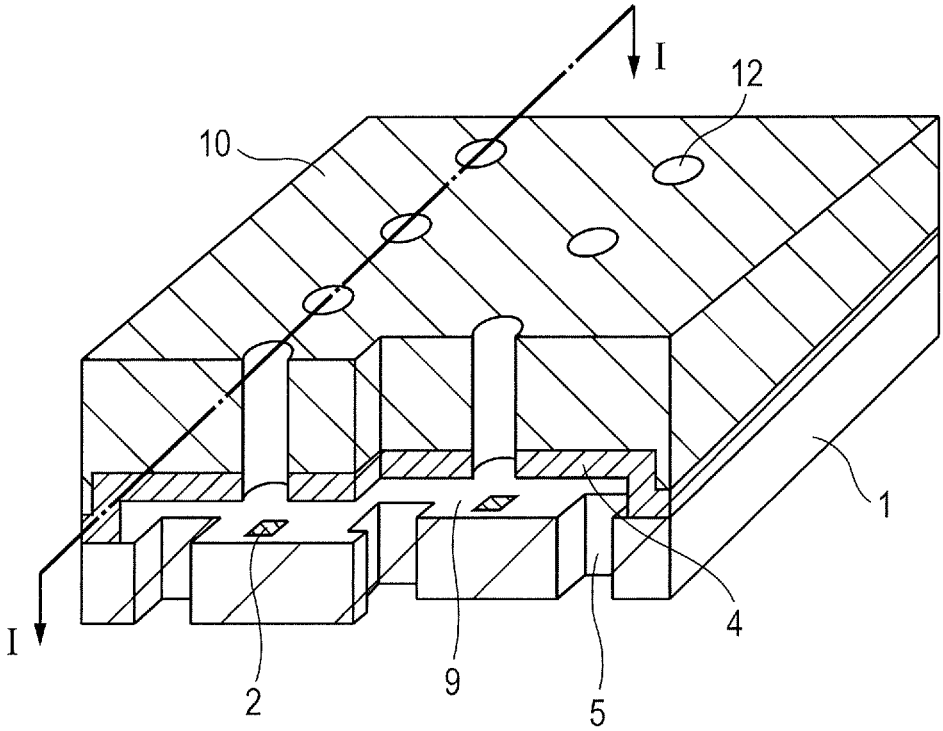
FIG. 3 is a schematic perspective view illustrating an example of a configuration of a liquid ejection head according to an embodiment of the present embodiment.

FIG. 3 is a schematic perspective view illustrating an example of a configuration of a liquid ejection head 20 of Embodiment 1.

FIGS. 1A to 1D are schematic views illustrating examples of a configuration of liquid ejection heads of the present embodiment, and are schematic cross-sectional views taken along line I-I in FIG. 3.

FIGS. 2A to 2F are cross-sectional process diagrams for describing a method for producing a liquid ejection head of the present embodiment.

In FIG. 3, the liquid ejection head has a substrate 1 on which ejection-energy-generating elements 2 are formed so as to be aligned at a predetermined pitch. Each of the ejection-energy-generating elements 2 is formed on the substrate, and may be formed so as to contact the substrate. Furthermore, the ejection-energy-generating element 2 may be formed so as to be in a state of floating in the air in the liquid chamber, that is, may float in the air with respect to the substrate 1. The substrate 1 is, for instance, a silicon substrate. On a first face (face on upper side in FIG. 3) of the substrate 1, an orifice plate 4 is arranged. The orifice plate 4 includes at least an ejection-orifice-forming wall 4*a* which forms an ejection orifice 8 for ejecting the liquid and the upper wall of a liquid chamber 9 that communicates with the ejection orifice 8, and a liquid chamber side wall 4*b* which constitutes a side wall of the liquid chamber 9. In addition, the orifice plate 4 includes a substrate-contacting wall 4*c*, which communicates with the liquid chamber side wall 4*b*. The ejection orifice 8 opens above the ejection-energy-generating element 2. In the substrate 1, a supply port 5 is formed which supplies a liquid such as ink to the liquid chamber 9. The supply port 5 opens to the first face of the substrate 1 and to a second face (face on lower side in FIG. 3) which is a face opposite to the first face. The supply port 5 can be formed, for instance, by anisotropic etching. In the liquid ejection head, the liquid chamber is filled with the liquid through the supply port 5, and the liquid is ejected through the ejection orifice 8 by applying a pressure generated by the ejection-energy-generating element 2 to the filled liquid. An image is recorded by adhesion of the ejected liquid to a recording medium.

In the present embodiment, the orifice plate 4 is formed of an inorganic material.

The liquid ejection head of the present embodiment also includes a plurality of liquid chambers, and an elastic member 10 filled in a depressed portion which is formed between the liquid chamber side wall of one liquid chamber of adjacent liquid chambers and the liquid chamber side wall of the other liquid chamber, that is, in a depressed portion 6 of the orifice plate, which is formed between the adjacent liquid chambers. In addition, the upper end of the elastic member 10 is arranged in a position higher than the upper face of an ejection-orifice-forming wall 4*a*. The upper end of the elastic member 10 means a place in an upper face of the elastic member 10 where a distance from the first face is farthest in terms of the direction perpendicular to the first face of the substrate 1. If the upper face of the elastic member 10 is parallel to the first face, any place of the upper face of the elastic member 10 results in the upper end. As for the upper face of the ejection-orifice-forming wall 4*a*, when there is a place where the upper face of the ejection-orifice-forming wall 4*a* is apparently not parallel to the first face of the substrate 1, the upper end of the ejection-orifice-forming wall 4*a* may be considered to be the upper face. The embodiment will be more specifically described below with reference to FIGS. 1A to 1D. In FIGS. 1A to 1D, the orifice plate 4 has a depressed portion 6 between the respective two adjacent liquid chambers 9. Specifically, the orifice plate 4 has a depressed portion 6 which is recessed from the surface of the ejection-orifice-forming wall, between a first liquid chamber side wall that forms the side wall of a first liquid chamber and a second liquid chamber side wall that forms the side wall of the liquid chamber adjacent to the first liquid chamber. Note that the first liquid chamber side wall and the second liquid chamber side wall face each other. The depressed portion 6 is formed of a valley portion between ridge portions which are formed of the liquid chambers provided so as to project from the substrate, and is formed between one liquid chamber side wall of the adjacent liquid chambers and the other liquid chamber side wall facing thereto. The depressed portion 6 is formed on the substrate-contacting wall 4*c*. The elastic member 10 is filled in the depressed portion 6 and is arranged there. In addition, the elastic member 10 is arranged also outside the depressed portion 6, and is formed so as to be thicker than the depth of the depressed portion 6. The upper end of the elastic member 10 is arranged in a position higher than the surface (upper face) of the ejection-orifice-forming wall 4*a*. The elastic member may be arranged also on the side wall of the end of the orifice plate which does not constitute the depressed portion.

The material of the elastic member is not particularly limited, but the elastic member can be formed of a resin, or a rubber such as a silicon rubber, a nitrile rubber, a fluororubber and an acrylic rubber. When patterning capability is considered, the elastic member can be formed of a photosensitive resin material using a photosensitive resin. The photosensitive resin material includes, for instance, OMR-81, OMR-83 and OMR-85 (any of which is trade name of product made by TOKYO OHKA KOGYO CO., LTD.).

The Young's modulus of the elastic member 10 can be $1.0\times10^7$ Pa or less. In addition, the Young's modulus of the elastic member 10 can be $1.0\times10^6$ Pa or more. When the Young's modulus of the elastic member 10 is $1.0\times10^7$ Pa or less, the liquid ejection head can more effectively absorb shock, and the durability of the liquid ejection head can be enhanced. When the Young's modulus of the elastic member 10 is $1.0\times10^6$ Pa or more, the liquid ejection head can adequately absorb shock. In addition, the Young's modulus of the elastic member 10 further can be $3.0\times10^6$ Pa or more, and still further can be $4.0\times10^6$ Pa or more. In addition, the Young's modulus of the elastic member 10 further can be $7.0\times10^6$ Pa or less, and still further can be $6.0\times10^6$ Pa or less.

In order that a liquid is accurately ejected, it is important to protect an ejection-orifice-forming wall which forms an ejection orifice. Thus, in the present embodiment, the elastic member 10 is filled in the depressed portion, and is formed so as to be thicker than the depth of the depressed portion. Specifically, a shock absorbing material 10 is formed so that the upper end of the elastic member is arranged in a position higher than the upper face of the ejection-orifice-forming wall. Thereby, the ejection-orifice-forming wall 4*a* can be effectively prevented from coming in contact with an object such as a recording paper sheet. In addition, even when the upper end of the elastic member 10 has received a physical shock, the elastic member 10 alleviates the shock by the deformation in a longitudinal direction, because of being formed comparatively thick, and can prevent a damage from occurring in the orifice plate.

The height of the upper end of the elastic member 10 can be higher than the height of the upper face of the ejection-orifice-forming wall 4*a* by 3 μm or more, and further can be higher by 4 μm or more. In addition, the height of the upper end of the elastic member 10 can be 30 μm or less from the height of the upper face of the ejection-orifice-forming wall 4*a*, further can be 20 μm or less therefrom, and still further can be 10 μm or less therefrom.

The configuration of the present embodiment will be described below with reference to FIGS. 1A to 1D.

Figure 1B:
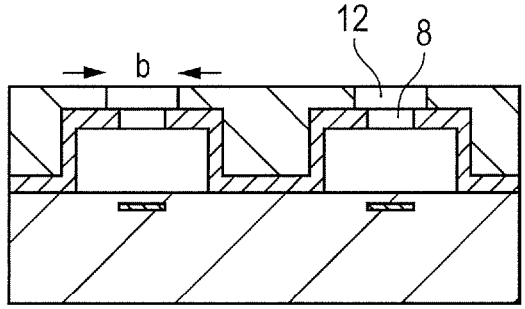

FIG. 1A and FIG. 1B are schematic cross-sectional views illustrating forms in which an elastic member 10 is arranged also on an ejection-orifice-forming wall 4*a* (on upper face thereof). In FIGS. 1A and 1B, the elastic member 10 is provided so as to cover at least a part of the ejection-orifice-forming wall 4*a*. When having received shock, the elastic member 10 absorbs the shock by the deformation of the elastic member itself. For this reason, as the volume of the elastic member 10 is larger, an effect of absorbing the shock becomes larger. Thus, in FIG. 1A, the depressed portion 6 is filled with the elastic member 10, and the elastic member is arranged further on the ejection-orifice-forming wall 4*a*. Thereby, the volume of the elastic member is increased as much as possible, and the effect of absorbing the shock is enhanced. In addition, the elastic member 10 is arranged also on the ejection-orifice-forming wall 4*a*, and thereby can effectively prevent the ejection-orifice-forming wall from coming in contact with an object such as a recording paper sheet.

In FIGS. 1A and 1B, the elastic member 10 has an opening 12 which communicates with the ejection orifice 8, on the ejection-orifice-forming wall 4*a*. In FIG. 1A, the opening width of the opening 12 of the elastic member 10 coincides with the opening width of the ejection orifice 8. Specifically, the opening 12 is formed so that the lower-side opening portion of the opening 12 coincides with the upper-side opening portion of the ejection orifice 8. In addition, in FIG. 1B, the opening width of the opening 12 of the elastic member 10 is larger than the opening width of the ejection orifice 8, and is smaller than the width of the ejection-orifice-forming wall 4*a*. Note that the opening width described here is a width in a direction parallel to the first face of the substrate 1.

Figure 1C:
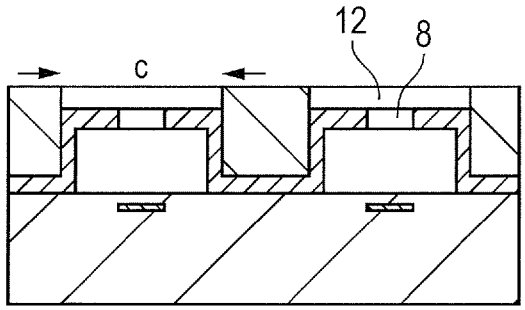

FIG. 1C illustrates a form in which the elastic member 10 is not arranged on the ejection-orifice-forming wall 4*a*. Alternatively, in the form illustrated in FIG. 1C, the elastic member 10 has the opening 12 which communicates with the ejection orifice 8, on the ejection-orifice-forming wall 4*a*, and the opening width of the opening 12 is the same as the width of the ejection-orifice-forming wall 4*a*. In addition, the lower-side opening portion of the opening 12 coincides with the upper face of the ejection-orifice-forming wall 4*a*.

When the width of the opening 12 in FIG. 1A is represented by 'a', the width of the opening 12 in FIG. 1B is represented by 'b', and the width of the opening 12 in FIG. 1C is represented by 'c', the widths form a relationship of $a<b<c$.

In any of FIGS. 1A, 1B and 1C, the upper end of the elastic member 10 is arranged in a position higher than the upper face of the ejection-orifice-forming wall. Due to this configuration, the liquid ejection head can prevent the ejection orifice from coming in contact with a paper sheet, even when paper jam has occurred. In addition, even when an external force is applied to the surface of the head, the elastic member can absorb the external force. As a result, the external force which will reach the orifice plate formed of the inorganic material is reduced. Because of this, the liquid ejection head of the present embodiment is configured so as not to easily be broken by the external force.

In addition, the forms illustrated in FIGS. 1A, 1B and 1C have each different advantage.

In FIG. 1A, the whole surface of the ejection-orifice-forming wall 4*a* is covered with the elastic member and accordingly an object does not come in direct contact with the ejection-orifice-forming wall 4*a*. Accordingly, the liquid ejection head is further configured so as not to easily be broken by an external force.

In FIG. 1C, the elastic member 10 is not arranged on the ejection-orifice-forming wall 4*a*. The thickness of the paper sheet which is commonly used is sufficiently larger than the opening width 'c', and accordingly the paper sheet does not come in direct contact with the ejection-orifice-forming wall 4*a*. Thus, the elastic member on the ejection-orifice-forming wall 4*a* is omitted. Due to a configuration like this, the shock does not easily reach the ejection-orifice-forming wall from the elastic member.

The liquid ejection head in FIG. 1B has effects in the above described FIG. 1A and FIG. 1C, and is suitable for the case where the width of an object that has a possibility of coming in contact with the ejection orifice is larger than the width 'a' of the ejection orifice, and is smaller than the width of the ejection-orifice-forming wall 4*a*.

Thus, in the present embodiment, the configuration concerning the opening width of the opening 12 can be selected so as to match a printing environment, in consideration of the thickness of a recording medium such as paper, which is used in a printer having the liquid ejection head mounted thereon; the size of an object other than the recording medium, which has a possibility of coming in contact with the ejection orifice; and the like.

Figure 1D:
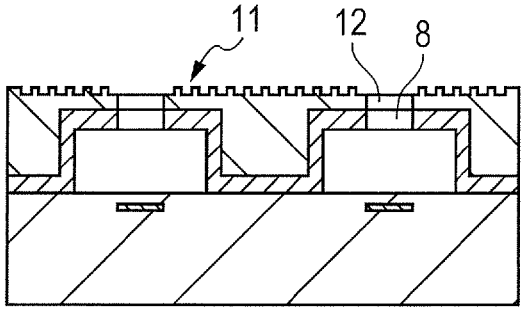

Furthermore, there can be a form illustrated in FIG. 1D as a configuration of the present embodiment. In FIG. 1D, the upper face of the elastic member 10 is formed into a shape having a plurality of micro roughness structures. The upper face of the elastic member is formed into a structure having the micro roughness, thereby a capability of alleviating the shock of the elastic member can be enhanced, and the liquid ejection head can be provided which further resists being broken by an external force.

Embodiment 2

Next, examples of steps in a production method of the present embodiment will be described with reference to FIGS. 2A to 2F.

Figure 2A:
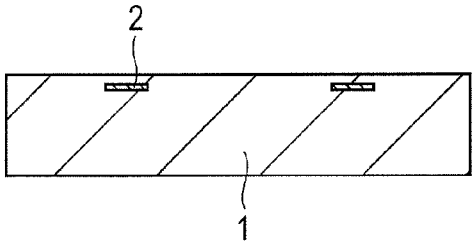
FIGS. 2A, 2B, 2C, 2D, 2E and 2F are cross-sectional process diagrams illustrating a process example of a method for producing a liquid ejection head according to an embodiment of the present embodiment.

Firstly, as is illustrated in FIG. 2A, a substrate 1 is prepared which has a plurality of ejection-energy-generating elements 2 on the first face.

The substrate 1 can be a silicon single-crystal substrate on which a driving circuit or a wiring that connects the driving circuit with the ejection-energy-generating element is easily formed. As for the ejection-energy-generating element 2, for instance, a heater type element which generates heat by causing electricity to pass through a resistor can be applied, and as another element than the heater type element, an element which can convert electricity into bubbling energy can be applied. The usable ejection-energy-generating elements include, for instance, a heating resistor, a piezoelectric body, and an actuator which is thermally deformed.

Figure 2B:
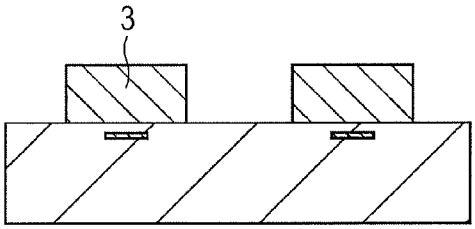

Next, as is illustrated in FIG. 2B, a mold material 3 which can be removed later is formed in a region that becomes the liquid chamber.

The material for the mold material can be appropriately selected in consideration of materials in the periphery. In the present embodiment, the orifice plate is formed of an inorganic material, and accordingly the material for the mold material can be selected from an organic resin material and a metal material. Polyimide can be suitably used as the organic resin material, from the viewpoint of heat resistance. Aluminum or an aluminum alloy can be suitably used as a metal material, from the viewpoint of being easily removed.

In addition, when the organic resin material to be used for an etching mask is used as the elastic member, the material for the mold material can be a metal material.

As for a method for forming the mold material 3, when an organic resin material is used as the material for the mold material, the mold material 3 can be deposited with the use of a general coating technique such as spin coating. When the material for the mold material has photosensitivity, the material for the mold material can be patterned by exposure and development. When the material for the mold material is nonphotosensitive, the material can be patterned with the use of a mask which has been formed on the material for the mold material and is formed of a photoresist or the like, by reactive ion etching (RIE: Reactive Ion Etching) containing oxygen gas. When the material for the mold material is a metal material, deposition can be performed by a physical vapor deposition method (PVD: Physical Vapor Deposition) such as sputtering. The metal material can be patterned by RIE which uses gas that has been selected according to the metal material, through a mask formed of a photoresist. When the metal material is aluminum, for instance, chlorine can be used as the etching gas.

Figure 2C:
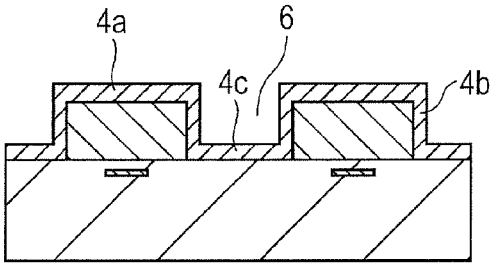

Next, as is illustrated in FIG. 2C, an orifice plate 4 formed of an inorganic material is formed on the substrate 1 and the mold material 3. The depressed portion 6 is formed in a region in which the mold material is not arranged.

The orifice plate 4 can be formed, for instance, by using a CVD method.

The inorganic material is not limited in particular, but includes, for instance, a silicon-based compound and ceramics. Usable silicon-based compounds include, for instance, a silicon-based compound formed of silicon and at least one of oxygen, nitrogen and carbon. More specifically, the silicon-based compounds include, for instance, silicon oxide, silicon nitride, silicon carbide and silicon carbonitride. The ceramics include, for instance, aluminum oxide and titanium oxide.

As for the deposition method of the inorganic material, the chemical vapor deposition (CVD) method can be used, and PECVD (Plasma Enhanced CVD) can be more favorably used. The CVD can be used because the film can be conformally formed. In addition, when the deposition is performed by using the CVD, a level difference is formed between a region in which the mold material is arranged and a region in which the mold material is not arranged, so that a deeper depressed portion 6 tends to be formed.

Figure 2D:
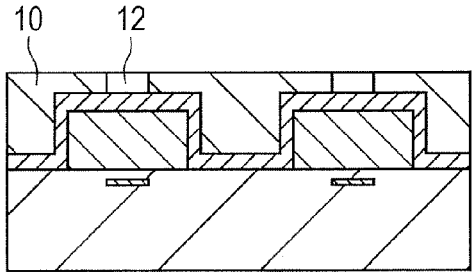

Next, as is illustrated in FIG. 2D, the elastic member 10 is formed on the orifice plate 4 including the depressed portion 6. The elastic member 10 is filled at least in the depressed portion 6, and is also arranged on the ejection-orifice-forming wall 4*a*. The elastic member 10 extends from the inside of the depressed portion 6 onto the ejection-orifice-forming wall.

In the production method of the present embodiment, the elastic member 10 is used also as an etching mask to be used when the ejection orifice is formed. As is illustrated in FIG. 2D, the opening 12 is provided in the elastic member 10, and an ejection orifice is formed in a portion of the orifice plate, which is exposed to this opening 12.

A usable method for arranging the material for the elastic member 10 includes, for instance, a spin coating method.

The material for the elastic member 10 can be a liquid, from the viewpoint of being easily applied onto the orifice plate by the spin coating method or the like. In addition, a material with which the Young's modulus of the elastic member 10 becomes $1.0\times10^7$ Pa or less can be used as the material for the elastic member 10.

In addition, the elastic member 10 can have photosensitivity. When having photosensitivity, the elastic member 10 can be patterned by exposure/development treatment. When being nonphotosensitive, the elastic member 10 can be patterned by reactive ion etching (RIE: Reactive Ion Etching) which uses oxygen gas as a main component. When the elastic member 10 has photosensitivity, the number of steps can be reduced.

Figure 2E:
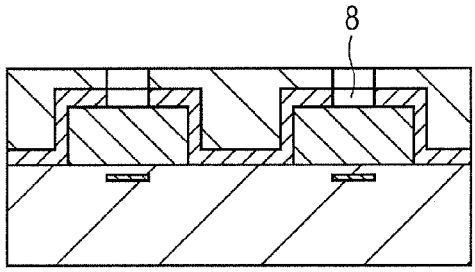

Next, as is illustrated in FIG. 2E, the ejection orifice 8 is formed by using the elastic member 10 as an etching mask. Specifically, an orifice plate portion which is exposed to the opening 12 of the elastic member 10 is removed, and the ejection orifice 8 is formed.

A usable method for forming the ejection orifice includes, for instance, a dry etching method. A usable dry etching method includes, for instance, RIE which uses fluorine as a main component.

Figure 2F:
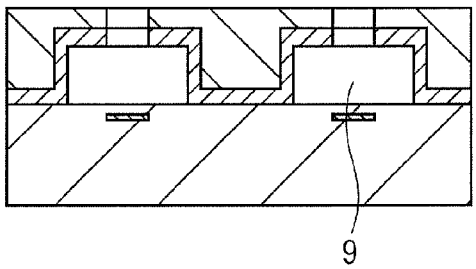

Next, as is illustrated in FIG. 2F, the mold material 3 is removed through the ejection orifice 8 to form the liquid chamber 9.

A usable method for removing the mold material includes, for instance, isotropic etching. When the material for the mold material is an organic resin material, the material can be removed by chemical dry etching (CDE: Chemical Dry Etching) which uses oxygen as a main component. In this case, a part of the surface of the elastic member 10 is also simultaneously removed, and accordingly the elastic member 10 can be thickly formed in consideration of the amount to be removed. If the material for the mold material is a metal material, the mold material can be removed by wet etching using a chemical liquid which can dissolve the selected metal material. When the metal material is, for instance, aluminum, the etching solution can be used which contains dilute sulfuric acid as a main component.

In the above process, a step of forming a supply port which supplies a liquid to the liquid chamber 9 is omitted, but the supply port can be formed, for instance, by etching the mold material from a second face which is a face opposite to the first face of the substrate, after the ejection orifice 8 has been formed.

Subsequently, the obtained substrate is cut and separated into chips by a dicing saw or the like, and accordingly a liquid ejection head is produced.

The obtained liquid ejection head is subjected to a process of producing electrical connection for driving the ejection-energy-generating element, and a chip tank member for supplying a liquid therefrom can be connected to the resultant liquid ejection head.

EXAMPLE 1

An example of the present invention will be described in detail below with reference to process diagrams illustrated in FIGS. 2A to 2F. However, the present invention is not limited to the following example.

Firstly, the configuration of a liquid ejection head to be obtained in the present example will be now described with reference to FIG. 2F. The orifice plate 4 which is formed of an inorganic material is formed on the substrate 1 having the ejection-energy-generating element 2 on the first face. The liquid chamber 9 is formed by the ejection-orifice-forming wall 4*a* and the liquid chamber side wall 4*b* of the orifice plate 4. The elastic member 10 is provided so as to cover the orifice plate 4. The orifice plate 4 was formed of silicon nitride (SiN) to have a film thickness of 5 μm. The elastic member 10 is formed of a photosensitive resin material (trade name: OMR-81 made by TOKYO OHKA KOGYO CO., LTD.) of which the Young's modulus is $5.0\times10^6$ Pa. The elastic member 10 is filled in the depressed portion 6, and the upper end of the elastic member 10 is configured to be higher than the upper face of the ejection-orifice-forming wall 4*a*. In addition, the thickness of a portion of the elastic member provided in the depressed portion 6 was 15 μm. The thickness of a portion of the elastic member provided on the ejection-orifice-forming wall 4*a* was 5 μm.

By such a configuration, when paper jam occurs or an object other than paper sheets is generated, which has a possibility of coming in contact with the ejection orifice, to apply an external force to the surface of the head, the elastic member exhibits an effect of suppressing transmission of the external force to the ejection-orifice-forming wall 4*a*. More specifically, the elastic member can absorb the external force. In addition, the width of the opening 12 of the elastic member is the same as that of the ejection orifice, and the clearance is minimal. Accordingly, the elastic member can prevent an object having a larger size than that of the ejection orifice from directly coming in contact with the ejection orifice. As a result, the liquid ejection head can be obtained which reduces the external force that may reach the orifice plate formed of the inorganic material and resists being broken by the external force.

Next, a production method of the present example will be described with reference to FIGS. 2A to 2F.

Firstly, as is illustrated in FIG. 2A, the substrate 1 was prepared which had an ejection-energy-generating element 2 on the first face. The thickness of the substrate is 110 μm. The substrate is a silicon single-crystal substrate of which the drawn orientation of the ingot is <100>. On the substrate, a wire (not-shown) necessary for driving the ejection-energy-generating element 2 is formed.

Next, as is illustrated in FIG. 2B, the mold material 3 which can be removed in a later step was formed in a region that corresponded to the ejection-energy-generating element to be the liquid chamber.

Aluminum was used as the material for the mold material. A film of aluminum was deposited by a physical vapor deposition method (PVD: Physical Vapor Deposition). The film thickness was 5 μm. The aluminum film was patterned in the following way. Firstly, a positive type resist (trade name: OFPR made by TOKYO OHKA KOGYO CO., LTD.) was applied onto the aluminum film by a spin coating method. Subsequently, the aluminum film was exposed to light in an exposure amount of 1 J/cm$^2$, and the resultant aluminum film was subjected to development treatment by NMD3 for 3 minutes. Thereby, a mold material with a thickness of 5 μm was formed.

Next, as is illustrated in FIG. 2C, an inorganic material was arranged with a PECVD method so as to cover the substrate 1 and the mold material 3, and an orifice plate was formed. SiN was used as the inorganic material.

Next, as is illustrated in FIG. 2D, the elastic member 10 is formed on the orifice plate. The elastic member 10 has the opening 12 on a region to form the ejection orifice. In addition, the elastic member 10 is filled at least in the depressed portion 6.

A photosensitive resin material (trade name: OMR-81 made by TOKYO OHKA KOGYO CO., LTD.) was used as the material for the elastic member 10.

The photosensitive resin material was applied to the orifice plate, then a region other than a region in which the opening 12 was to be formed was exposed to light with an exposure amount of 2 J/cm$^2$, the exposed region was developed for 3 minutes, and thereby the elastic member 10 was formed. The Young's modulus of the elastic member 10 was $5.0\times10^6$ Pa.

Next, as is illustrated in FIG. 2E, the orifice plate portion which was exposed to the opening 12 was removed, and thereby the ejection orifice 8 was formed.

The ejection orifice was formed by RIE (reactive ion etching) using fluorine as a main component with the elastic member 10 as an etching mask.

Next, a protective layer for protecting the orifice plate was formed. A resist (trade name: OBC made by TOKYO OHKA KOGYO CO., LTD.) having resistance to an alkaline solvent was used as the protective film. After that, a supply port for supplying a liquid to the liquid chamber was formed with an alkaline solvent (trade name: TMAH made by TOKYO OHKA KOGYO CO., LTD.), from a side of the substrate where the orifice plate was not formed, in other words, from the side of the second face (not shown).

Next, as is illustrated in FIG. 2F, the mold material 3 was removed, and the liquid chamber 9 was formed. The mold material was dissolved and removed with the use of dilute sulfuric acid.

Subsequently, the obtained substrate was cut and separated into chips by a dicing saw, and a liquid ejection head was formed.

The obtained liquid ejection head was subjected to a process of producing electrical connection for driving the ejection-energy-generating element, a chip tank member was connected to the resultant liquid ejection head, and thereby a liquid ejection head apparatus was produced.

Finally, in order to confirm an effect of the liquid ejection head which was produced in the above described method, the durability with respect to paper jam was checked with the use of the obtained liquid ejection head apparatus. As a result, no crack was recognized in the nozzle.

EXAMPLE 2

An example of the present invention will be described in detail below with reference to process diagrams illustrated in FIGS. 4A to 4I. However, the present invention is not limited to the following example.

Firstly, the configuration of a liquid ejection head to be obtained in the present example will be now described with reference to FIG. 4I. The configuration of the liquid ejection head of the present example has a structure in which the opening width of the opening 12 of the elastic member in FIG. 2F in Example 1 has been enlarged. The opening width of the opening 12 (which is expressed as a second opening 12 in the present example) is the above described 'b', is larger than the opening width 'a' (width of ejection orifice) in FIG. 2F in Example 1, and is smaller than the width 'c' of the ejection-orifice-forming wall 4*a*.

In the present example, the steps of FIGS. 4A to 4E are the same as those of FIGS. 2A to 2E, and accordingly the description will be omitted. Note that in the present example, the opening 12 in Example 1 is expressed as a first opening 12'.

The steps of FIGS. 4F to 4I will be described below.

Figure 4A:
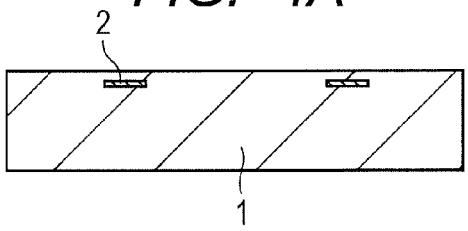
FIGS. 4A, 4B, 4C, 4D, 4E, 4F, 4G, 4H and 4I are cross-sectional process diagrams illustrating a process example of a method for producing a liquid ejection head according to an embodiment of the present embodiment.
Figure 4B:
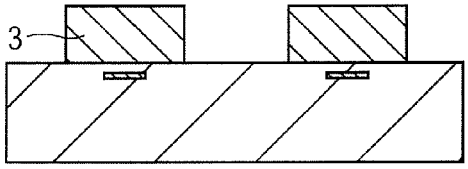
Figure 4C:
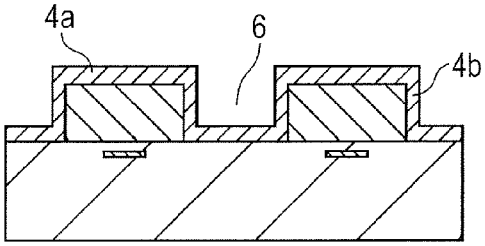
Figure 4D:
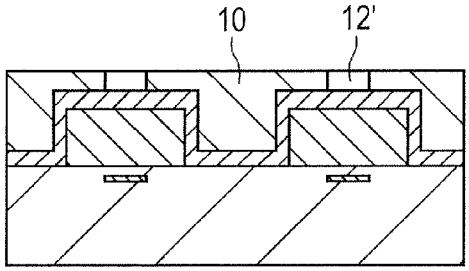
Figure 4E:
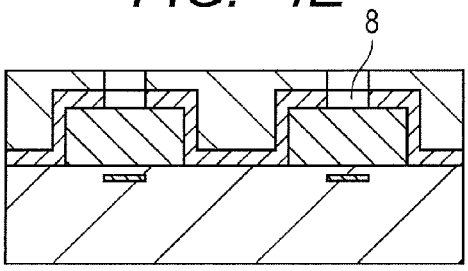
Figure 4F:
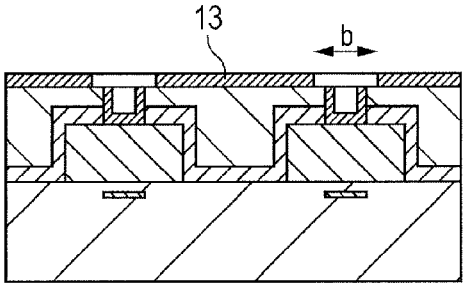

As is illustrated in FIG. 4F, an etching mask 13 for widening the opening width of the first opening 12', in other words, for forming the second opening 12 having the opening width 'b' was formed on the whole surface of the substrate including the ejection orifice and the surface of the elastic member, with the use of a spray method.

A positive type resist (trade name: AZP4620 by AZ Electronic Materials) was used as a material for the etching mask 13. The positive type resist was applied onto the substrate, the applied resist was exposed to light with an exposure amount of 2 J/cm$^2$, and the exposed resist was developed by NMD3 for 3 minutes, and thereby the etching mask 13 (with a film thickness of 3 μm) was formed. The spray coating method has an advantage of being capable of decreasing film loss of the elastic member when the resist is removed in a later step, since the ejection orifice can be covered with a small amount of resist compared to the spin coating method.

Figure 4G:
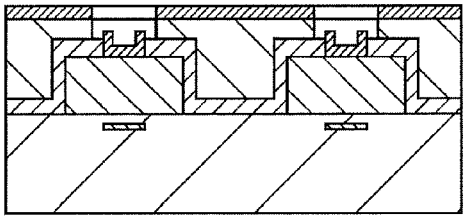

Next, as is illustrated in FIG. 4G, the second opening 12 (opening width 'b') was formed in the elastic member by being subjected to RIE using the etching mask 13.

Figure 4H:
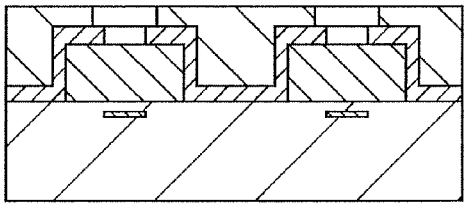

Next, as is illustrated in FIG. 4H, the etching mask 13 was removed by CDE (Chemical Dry Etching).

Next, in a similar way to that in Example 1, a protective layer was formed, and then a supply port (not-shown) was formed.

Figure 4I:
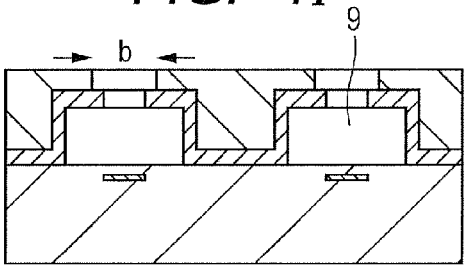

Next, as is illustrated in FIG. 4I, the mold material was removed, and the liquid chamber 9 was formed.

Subsequently, the obtained substrate was cut and separated into chips by a dicing saw, and a liquid ejection head was produced.

The obtained liquid ejection head was subjected to a process of producing electrical connection for driving the ejection-energy-generating element, a chip tank member was connected to the resultant liquid ejection head, and thereby a liquid ejection head apparatus was produced.

Finally, in order to confirm an effect of the liquid ejection head which was produced in the above described method, the durability with respect to paper jam was checked with the use of the obtained liquid ejection head apparatus. As a result, no crack was recognized in the nozzle.

EXAMPLE 3

An example of the present invention will be described in detail below with reference to process diagrams illustrated in FIGS. 5A to 5I.

Firstly, the configuration of a liquid ejection head to be obtained in the present example will be now described with reference to FIG. 5I. The configuration of the liquid ejection head of the present example has a structure in which the opening width of the second opening of the elastic member in FIG. 4I of Example 2 is enlarged. The opening width of the second opening 12 is the above described 'c'. Because of this, the liquid ejection head illustrated in FIG. 5I has a structure in which the elastic member is not arranged on the ejection-orifice-forming wall 4*a*.

In the present example, the steps of FIGS. 5A to 5E are the same as those of FIGS. 4A to 4E, and accordingly the description will be omitted.

The steps of FIGS. 5F to 5I will be described below.

Figure 5A:
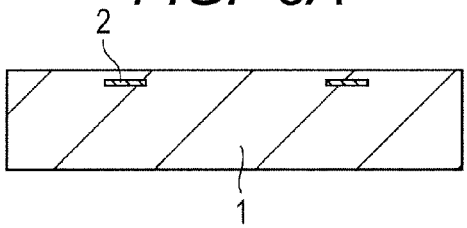
FIGS. 5A, 5B, 5C, 5D, 5E, 5F, 5G, 5H and 5I are cross-sectional process diagrams illustrating a process example of a method for producing a liquid ejection head according to an embodiment of the present embodiment.
Figure 5B:
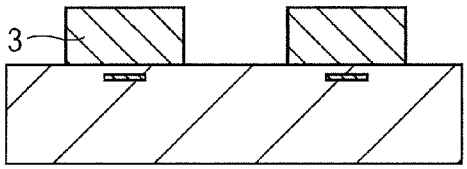
Figure 5C:
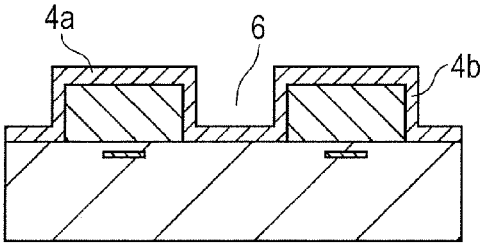
Figure 5D:
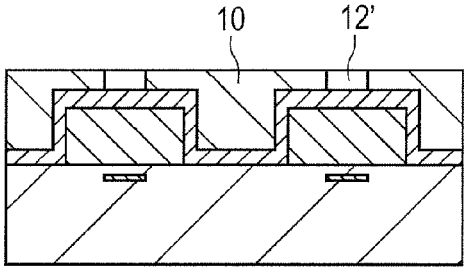
Figure 5E:
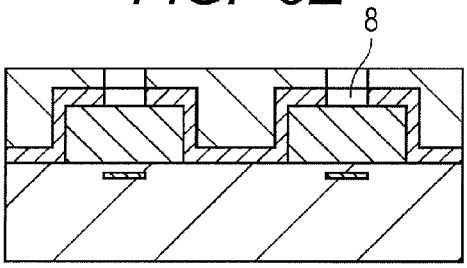
Figure 5F:
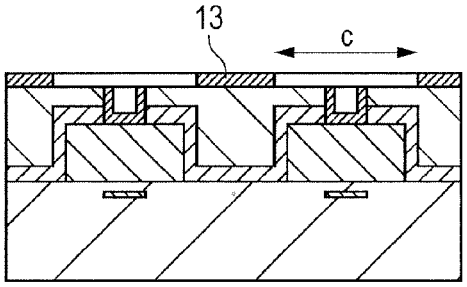

As is illustrated in FIG. 5F, the etching mask 13 for widening the opening width of the first opening 12', in other words, for forming the second opening 12 having the opening width 'c', was formed on the whole surface of the substrate including the ejection orifice and the surface of the elastic member, with the use of a spray method.

A positive type resist (trade name: AZP4620 by AZ Electronic Materials) was used as a material for the etching mask 13. The positive type resist was applied onto the substrate, the applied resist was exposed to light with an exposure amount of 2 J/cm$^2$, and the exposed resist was developed by NMD3 for 3 minutes, and thereby the etching mask 13 (with a film thickness of 3 μm) was formed. The spray coating method has an advantage of capable of decreasing film loss of the elastic member when the resist is removed in a later step, since the ejection orifice can be covered with a small amount of resist compared to the spin coating method.

Figure 5G:
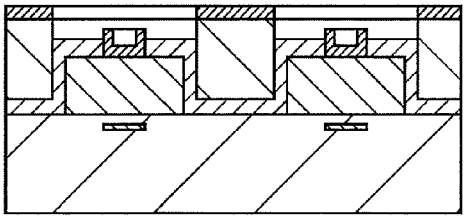

Next, as is illustrated in FIG. 5G, the second opening 12 (opening width 'c') was formed in the elastic member by being subjected to RIE using the etching mask 13.

Figure 5H:
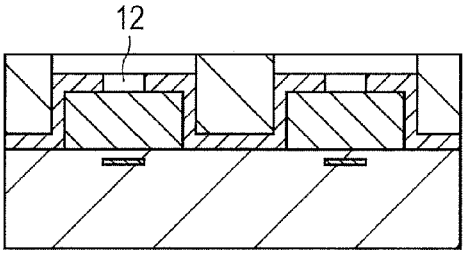

Next, as is illustrated in FIG. 5H, the etching mask 13 was removed by CDE.

Next, in a similar way to that in Example 1, a protective layer was formed, and then a supply port (not-shown) was formed.

Figure 5I:
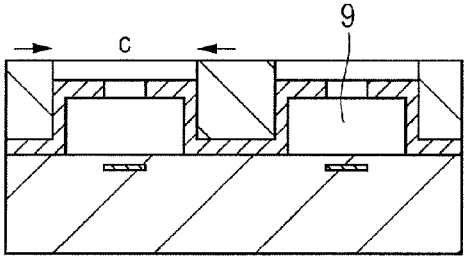

Next, as is illustrated in FIG. 5I, the mold material was removed, and the liquid chamber 9 was formed.

Subsequently, the obtained substrate was cut and separated into chips by a dicing saw, and a liquid ejection head was produced.

The obtained liquid ejection head was subjected to a process of producing electrical connection for driving the ejection-energy-generating element, a chip tank member was connected to the resultant liquid ejection head, and thereby a liquid ejection head apparatus was produced.

Finally, in order to confirm an effect of the liquid ejection head which was produced in the above described method, the durability with respect to paper jam was checked with the use of the obtained liquid ejection head apparatus. As a result, the crack was not recognized in the nozzle.

EXAMPLE 4

An example of the present invention will be described in detail below with reference to process diagrams illustrated in FIGS. 6A to 6I.

Firstly, the configuration of a liquid ejection head to be obtained in the present example will be now described below with reference to FIG. 6I. The structure of the liquid ejection head of the present example is formed to be a structure in which the upper face of the elastic member of the liquid ejection head in Example 1 has a plurality of micro roughness structures (hereinafter also referred to as a micro roughness structure). In the present example, as for the shape of the micro roughness 11, all of length, width and height were 3 μm. By forming the upper face of the elastic member into the micro roughness structure, the elastic member can enhance a capability of alleviating shock. The micro roughness structure can include, for instance, a structure in which a plurality of micro projections with a columnar shape, a conical shape, a prismatic shape or a pyramid shape are arranged. The micro projections can be regularly arranged. The height of the micro projection is, for instance, 0.1 μm or more and 0.5 μm or less. The longest width of the cross section (for instance, if the cross section shows a circular shape, it is the diameter) perpendicular to an extension direction of the micro projections is, for instance, 0.01 μm or more and 0.1 μm or less. The distance between the vertexes of the adjacent micro projections is, for instance, 0.01 μm or more and 0.1 μm or less.

In the present example, the steps of FIGS. 6A to 6E are the same as those of FIGS. 2A to 2E, and accordingly the description will be omitted.

The steps of FIGS. 6F to 6I will be described below.

Figure 6A:
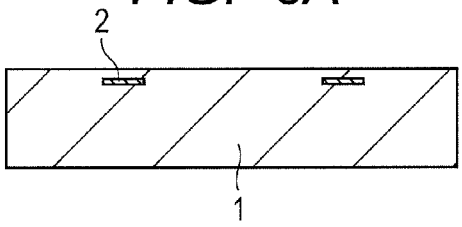
FIGS. 6A, 6B, 6C, 6D, 6E, 6F, 6G, 6H and 6I are cross-sectional process diagrams illustrating a process example of a method for producing a liquid ejection head according to an embodiment of the present embodiment.
Figure 6B:
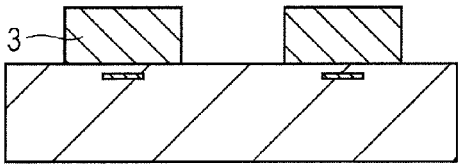
Figure 6C:
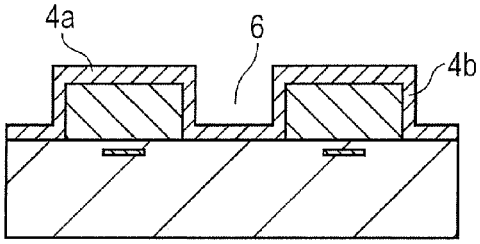
Figure 6D:
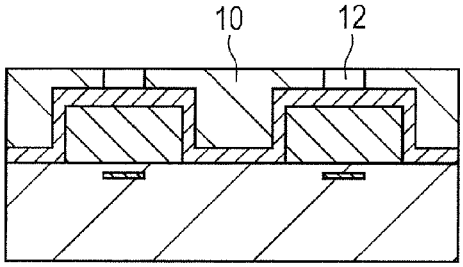
Figure 6E:
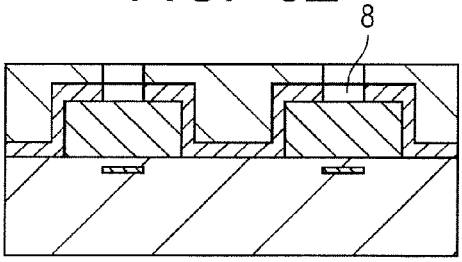
Figure 6F:
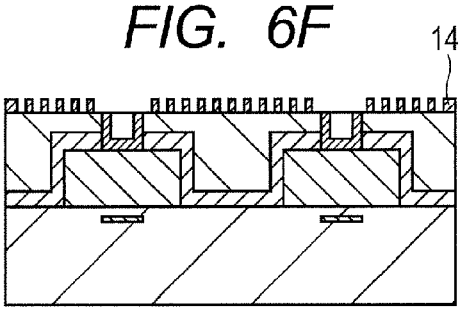

As is illustrated in FIG. 6F, an etching mask 14 for forming the micro roughness, which would be used for forming the micro roughness 11 on the elastic member 10, was formed on the elastic member.

A positive type resist (trade name: AZP4620 by AZ Electronic Materials) was used as a material for the etching mask 14 for forming micro roughness. The positive type resist was applied onto the substrate, the applied resist was exposed to light with an exposure amount of 2 J/cm$^2$, and the exposed resist was developed by NMD3 for 3 minutes, and thereby the etching mask 14 (with film thickness of 3 μm) for forming micro roughness was formed.

Figure 6G:
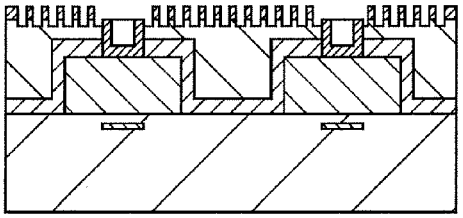

Next, as is illustrated in FIG. 6G, the upper face of the elastic member was formed into the micro roughness structure by RIE, using the etching mask 14 for forming micro roughness.

As for the shape of the micro roughness 11, all of the length, the width and the height were 3 μm, and the micro roughness 11 was uniformly arranged on the whole upper face of the elastic member.

Figure 6H:
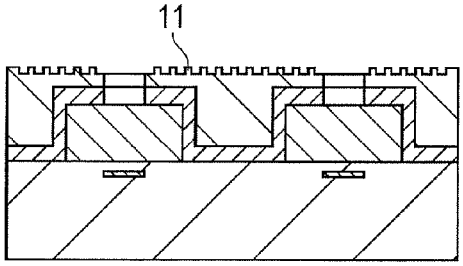

Next, as is illustrated in FIG. 6H, the etching mask 14 for forming the micro roughness was removed by CDE.

Next, in a similar way to that in Example 1, a protective layer was formed, and then a supply port (not-shown) was formed.

Figure 6I:
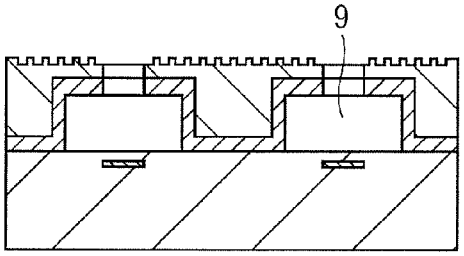

Next, as is illustrated in FIG. 6I, the mold material was removed, and the liquid chamber 9 was formed.

Subsequently, the obtained substrate was cut and separated into chips by a dicing saw, and the liquid ejection head was produced.

The obtained liquid ejection head was subjected to a process of producing electrical connection for driving the ejection-energy-generating element, a chip tank member was connected to the resultant liquid ejection head, and a liquid ejection head apparatus was produced.

Finally, in order to confirm an effect of the liquid ejection head which was produced in the above described method, the durability with respect to paper jam was checked with the use of the obtained liquid ejection head apparatus. As a result, no crack was recognized in the nozzle.

The present invention can be applied to a recording head of an ink-jet printer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-225401, filed Oct. 30, 2013, which is hereby incorporated by reference herein in its entirety.

What is claimed is:

1. A liquid ejection head comprising:

a substrate having an ejection-energy-generating element for generating energy for ejecting a liquid;

an orifice plate including at least an ejection-orifice-forming wall that constitutes an ejection orifice for ejecting the liquid and an upper wall of a liquid chamber communicating with the ejection orifice, and a liquid chamber side wall that constitutes a side wall of the liquid chamber, wherein the orifice plate is formed of an inorganic material, the liquid ejection head comprises:

a plurality of liquid chambers; and an elastic member filled into a depressed portion formed between the liquid chamber side wall of one liquid chamber of the liquid chambers adjacent to each other and the liquid chamber side wall of the other liquid chamber, and an upper end of the elastic member is arranged in a position higher than an upper face of the ejection-orifice-forming wall.

2. The liquid ejection head according to claim 1, wherein the elastic member is arranged also on the ejection-orifice-forming wall.

3. The liquid ejection head according to claim 2, wherein the elastic member has an opening which communicates with the ejection orifice, on the ejection-orifice-forming wall.

4. The liquid ejection head according to claim 3, wherein a width of the opening is larger than a width of the ejection orifice, and is smaller than a width of the ejection-orifice-forming wall.

5. The liquid ejection head according to claim 3, wherein the width of the opening coincides with the width of the ejection orifice.

6. The liquid ejection head according to claim 1, wherein the elastic member is not arranged on the ejection-orifice-forming wall.

7. The liquid ejection head according to claim 1, wherein an upper face of the elastic member is formed into a shape having a plurality of micro roughness structures.

8. The liquid ejection head according to claim 1, wherein a Young's modulus of the elastic member is $1.0\times10^7$ Pa or less.

9. The liquid ejection head according to claim 1, wherein a Young's modulus of the elastic member is $1.0\times10^6$ Pa or more.

10. A method for producing the liquid ejection head according to claim 1 comprising:

(1) forming a mold material of the liquid chamber on the substrate;

(2) forming the orifice plate on the mold material by a chemical vapor deposition method;

(3) forming an etching mask so as to cover the orifice plate; and (4) forming the ejection orifice by using the etching mask, wherein the etching mask is left to function as the elastic member.

11. The method for producing the liquid ejection head according to claim 10, wherein the etching mask is formed by using a photosensitive resin material.

* * * * *